US006849796B2

(12) United States Patent
Yamaguchi

(10) Patent No.: US 6,849,796 B2
(45) Date of Patent: Feb. 1, 2005

(54) OPERATION DETECTION SWITCH, MUSICAL INSTRUMENT AND PARAMETER DETERMINATION PROGRAM

(75) Inventor: Tsutomu Yamaguchi, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 117 days.

(21) Appl. No.: 10/370,939

(22) Filed: Feb. 20, 2003

(65) Prior Publication Data

US 2003/0159571 A1 Aug. 28, 2003

(30) Foreign Application Priority Data

Feb. 25, 2002 (JP) ..... 2002-047829

(51) Int. Cl.[7] ..... G10H 1/18
(52) U.S. Cl. ..... 84/720
(58) Field of Search ..... 84/718–720, 743–745; 200/5 A

(56) References Cited

U.S. PATENT DOCUMENTS 4,668,843 A * 5/1987 Watanabe et al. ..... 200/5 A
4,901,614 A * 2/1990 Kumano et al. ..... 84/719
5,062,342 A * 11/1991 Nagatsuma ..... 84/744
5,453,571 A * 9/1995 Adachi et al. ..... 84/658
5,952,629 A * 9/1999 Yoshinaga et al. ..... 200/5 A
6,075,213 A * 6/2000 Ichiro ..... 200/1 B
6,147,290 A * 11/2000 Uno ..... 84/433
6,765,142 B2 * 7/2004 Sakurada et al. ..... 84/719

* cited by examiner

*Primary Examiner*—Jeffrey W Donels
(74) *Attorney, Agent, or Firm*—Davis & Bujold, P.L.L.C.

(57) ABSTRACT

An operation detection switch capable of reproducing the manner of performance in which the speed of depressing an operating portion changes in the middle of a key action and of achieving a reduced manufacturing cost. The operation detection switch includes a switch main body and legs. A fulcrum projection, a first extending portion, protrusion and a second extending portion are provided in sequence along one end to the other end of and extending from the switch main body. Furthermore, a pressure projection is provided on the other end of the switch main body. Movable contacts corresponding to fixed contacts formed on a printed circuit board are formed at the tips of the first and the second extending portions. The operation detection switch and the printed circuit board constitute a detection device for detecting the depressing action of the key.

20 Claims, 13 Drawing Sheets

FIG.7

| T1(ms) | T2(ms) | TONE | VOLUME |
|---|---|---|---|
| 2 | 0 | TONE a1 | VOLUME a1 |
| | 2 | TONE a2 | VOLUME a2 |
| | 4 | TONE a3 | VOLUME a3 |
| | ⋮ | ⋮ | ⋮ |
| | 20 | TONE ab | VOLUME ab |
| 10 | 0 | TONE e1 | VOLUME e1 |
| | 2 | TONE e2 | VOLUME e2 |
| | ⋮ | ⋮ | ⋮ |
| | 20 | TONE eb | VOLUME eb |
| 12 | 0 | TONE f1 | VOLUME f1 |
| | 2 | TONE f2 | VOLUME f2 |
| | ⋮ | ⋮ | ⋮ |

OPERATION DETECTION SWITCH, MUSICAL INSTRUMENT AND PARAMETER DETERMINATION PROGRAM

BACKGROUND OF THE INVENTION (i) Field of the Invention

The present invention relates to an operation detection switch for use in detecting an operating portion of a musical instrument being operated.

(ii) Description of the Related Art

A typical conventional operation detection switch for detecting an operating portion of a musical instrument being operated comprises a switch main body disposed between the operating portion of the musical instrument and the surface of a circuit board having a first and a second fixed contacts formed thereon, and a first and a second movable contacts corresponding respectively to the first and the second fixed contacts. The first and the second movable contacts are provided on the switch main body.

In a keyboard instrument such as an electronic piano or an electronic organ, for example, the first and the second fixed contacts are formed in sequence along the length direction of each key as an operating portion of the keyboard instrument, and the operation detection switch is disposed so as to face the surface of the circuit board. In accordance with the depression of the key, the switch main body, which is directly or indirectly pressed by the key, pivots around one end of itself as a fulcrum point, with the result that the first movable contact abuts the first fixed contact, then the second movable contact abuts the second fixed contact. FIG. 12A is a graph plotting the stroke in abscissa and the state of action (ON or OFF) of the switches s1 and s2 constituted by the first and the second movable contacts in combination with the first and the second fixed contacts, respectively, in ordinate.

In the keyboard instrument, sound parameters (e.g. volume, tone) corresponding to the depressing action are determined based on the required time period from when the first movable contact abuts the first fixed contact until when the second movable contact abuts the second fixed contact, then the sound having the determined parameters is output from a loudspeaker or the like.

In the case of using such a switch, however, a depressing action of the key can be detected only at two reference timing points, i.e., when the first movable contact abuts the first fixed contact and when the second movable contact abuts the second fixed contact. Accordingly, as long as the time period between the above two reference timing points when the depressing action is detected is the same (see FIG. 13A: t1=t2=t3), the same parameters are determined regardless of whether or not the speed of the key depression has changed in the middle of the action. Therefore, the manner of performance in which the speed of depressing the operating portion changes in the middle of the action cannot be covered.

A recent solution to this problem is to detect the depressing action of a key by using an operation detection switch provided with a first, a second and a third movable contacts for abutting a first, a second and a third fixed contacts, respectively, which enables detection of the depressing action of the key at three reference timing points. By this, even in the case where the total time period required to detect the depressing action, i.e. the time period from the first to the third reference timing point, is the same (see FIG. 13B: t1=t2=t3), sounds having different parameters can be determined if the time period between the respective two reference timing points is different (see FIG. 13B: t11≠t21≠t31, t12≠t22≠t32). Therefore, the manner of performance in which the speed of depressing the operating portion changes in the middle of the action can be covered. FIG. 12B is a graph plotting the stroke of the key while being depressed in abscissa and the state of action (ON or OFF) of the switches s1, s2 and s3 constituted by the first, the second and the third movable contacts in combination with the first, the second and the third fixed contacts, respectively, in ordinate.

However, the operation detection switch having three movable contacts involves a problem that the manufacturing cost of the operation detection switch itself is increased due to the increased number of movable contacts compared with an operation detection switch having only two movable contacts. Furthermore, three fixed contacts must be formed on the circuit board, which inevitably increases the manufacturing cost of an entire musical instrument.

The object of the present invention is to provide an operation detection switch and a musical instrument that can cover the manner of performance in which the speed of depressing the operating portion changes in the middle of the action, while requiring a reduced manufacturing cost compared with a prior art operation detection switch and a musical instrument. Another object of the present invention is to provide a parameter determination program available for such a musical instrument.

SUMMARY OF THE INVENTION

The above and other objects are attained by an operation detection switch comprising: a switch main body disposed between an operating portion of a musical instrument and the surface of a circuit board having a first and a second fixed contacts formed thereon; a first and a second extending portions extending respectively from the switch main body and provided at their tips with movable contacts corresponding to the first and the second fixed contacts; and a protrusion protruding toward the surface of the circuit board from the switch main body between the first and the second extending portions.

When the operating portion is depressed, the switch main body is directly or indirectly pressed by the operating portion and pivots around one end of the switch main body as a first fulcrum point, whereby the movable contact of the first extending portion abuts the first fixed contact, then the movable contact of the second extending portion abuts the second fixed contact. As the operating portion is further depressed after the movable contacts of the first and the second extending portions abut the first and the second fixed contacts in sequence, the switch main body pivots around the protrusion as a second fulcrum point, with the movable contact of the second extending portion abutting the second fixed contact and the second extending portion being elastically deformed, and thereby the movable contact of the first extending portion detaches from the first fixed contact.

According to the operation detection switch having the above described structure, it is possible to detect three time points, i.e., a reference timing point when the movable contact of the first extending portion abuts the first fixed contact, a reference timing point when the movable contact of the second extending portion abuts the second fixed contact and a reference timing point when the movable contact of the first extending portion detaches from the first fixed contact, by means of two movable contacts. Therefore, the way of performance in which the speed of depressing the operating portion changes in the middle of action can be covered by means of only two movable contacts, and also a reduced manufacturing cost of the operation detection switch itself can be achieved, compared with an operation detection switch for detecting the depressing action of the operating portion by means of three movable contacts.

The above described operation detection switch may be utilized in a musical instrument wherein the operating portion is depressed by the performance of a player, e.g. a keyboard instrument such as an electronic piano or an electronic organ, so as to detect the depression of each key as the operating portion.

Specifically, the switch main body is disposed so as to face the surface of a circuit board on which a first and a second fixed contacts are formed in sequence along the length direction of the key constituting the keyboard (or along the abutting surface of the hammer). As the key is depressed, the switch main body is directly or indirectly pressed by the key and pivots around one end of the switch main body as the first fulcrum point, whereby the movable contact of the first extending portion abuts the first fixed contact, then the movable contact of the second extending portion abuts the second fixed contact. As the key is further depressed after the movable contacts of the first and the second extending portions abut the first and the second fixed contacts in sequence, the switch main body pivots around the protrusion as the second fulcrum point with the movable contact of the second extending portion abutting the second fixed contact and the second extending portion being elastically deformed, and thereby the movable contact of the first extending portion detaches from the first fixed contact.

According to this structure, the manner of performance in which the speed of depressing the key changes in the middle of action can be covered by means of only two movable contacts.

The above described operation detection switch may be utilized in a percussion instrument such as electronic drums which are also musical instruments wherein the operating portion is depressed by the performance of a player, so as to detect the depression of a pad as the operating portion of a percussion instrument.

Specifically, the switch main body is disposed so as to face the surface of a circuit board on which a first and a second fixed contacts are formed in sequence along the surface of the pad. As the pad is depressed, the switch main body is directly or indirectly pressed by the pad and pivots around one end of the switch main body as the first fulcrum point, whereby the movable contact of the first extending portion abuts the first fixed contact, then the movable contact of the second extending portion abuts the second fixed contact. As the pad is further depressed after the movable contacts of the first and the second extending portions abut the first and the second fixed contacts in sequence, the switch main body pivots around the protrusion as the second fulcrum point with the movable contact of the second extending portion abutting the second fixed contact and the second extending portion being elastically deformed, and thereby the movable contact of the first extending portion detaches from the first fixed contact.

According to this structure, the way of performance in which the speed of depressing the pad changes in the middle of action can be covered by means of only two movable contacts.

In another aspect of the present invention, there is provided an operation detection switch having a switch main body provided with a pressure projection at the opposite end to the first fulcrum point, wherein the switch main body is pressed by the operating portion through the pressure projection as the operating portion is depressed.

In the operation detection switch designed above, since the pressure projection is provided at the other end of the switch main body, the switch main body is depressed by the operating portion through the pressure projection. It serves to prevent the point to be depressed by the operating portion (i.e., the point of pressure application) from shifting from the other end of the switch main body, compared with a structure without a pressure projection. If the point to be pressed by the operating portion shifts, the load necessary for pivoting the switch main body may change, and as a result, the timing of the movable contacts of the first and the second extending portions abutting the first and the second fixed contacts may be shifted. Therefore, the operation detection switch having the above described structure enables stabilization of its own performance.

In a further aspect of the present invention, there is provided an operation detection switch having a switch main body provided with a fulcrum projection protruding toward the surface of the circuit board at one end of the switch main body, wherein the switch main body pivots around the fulcrum projection as the first fulcrum point as the operating portion is depressed.

According to the operation detection switch designed as above, the switch main body which pivots around the fulcrum projection as the first fulcrum point serves to prevent the point (the fulcrum) of the switch main body for abutting the surface of the circuit board from shifting from the one end of the switch main body, compared with a structure without such a fulcrum projection. If the point of the switch main body for abutting the surface of the circuit board shifts, the load necessary for pivoting the switch main body may change, and as a result, the timing of the movable contacts of the first and the second extending portions abutting the first and the second fixed contacts may be shifted. Therefore, the operation detection switch having the above described structure enables stabilization of its own performance.

In another aspect of the present invention, there is provided a musical instrument comprising parameter determination means for detecting the depressing action of the operating portion by means of any of the operation detection switches described above, and for determining sound parameters in accordance with the detected depressing action, wherein the parameter determination means determine the sound parameters based on a required time period from when the movable contact of the first extending portion abuts the first fixed contact until when the movable contact of the second extending portion abuts the second fixed contact and a required time period from when the movable contact of the second extending portion abuts the second fixed contact until when the movable contact of the first extending portion detaches from the first fixed contact.

According to the above musical instrument, the depressing action of the operating portion can be detected at three reference timing points although only two fixed contacts are formed for one operation detection switch. This enables a more simplified wiring pattern to be formed on the circuit board compared with a structure wherein the depressing action of the operating portion is detected by means of three fixed contacts, with the result that the circuit board itself can be downsized, and therefore the manufacturing cost of the entire musical instrument can be reduced.

In yet another aspect of the invention, there is provided a parameter determination program for determining sound parameters in accordance with the detected depressing action in a musical instrument capable of detecting depressing action of an operating portion by means of any of the operation detection switches as described above. The parameter determination program is used for a computer system to execute the procedure of determining sound parameters based on a required time period from when the movable contact of the first extending portion abuts the first fixed contact until when the movable contact of the second extending portion abuts the second fixed contact and a required time period from when the movable contact of the second extending portion abuts the second fixed contact until when the movable contact of the first extending portion detaches from the first fixed contact.

The computer system to execute the parameter determination program may be, for example, built in a musical instrument or connected to a musical instrument through cables and the like. The parameter determination program may be provided for users via recording media such as a CD-ROM, or communication lines such as the Internet.

The computer system for determining sound parameters in accordance with the parameter determination program may function as the parameter determination means in a musical instrument mentioned above.

Furthermore, even a conventional musical instrument provided with an operation detection switch for detecting the depressing action of the operating portion at two reference timing points may function as a musical instrument according to the present invention, by replacing its operation detection switch with the operation detection switch according to the present invention as well as installing the parameter determination program according to the present invention thereinto.

BRIEF DESCRIPTION OF THE DRAWINGS

A preferred embodiment according to the present invention will now be described with reference to the drawings in which:

FIG. 7 is a view showing the data structure of a data table;

DETAILED DESCRIPTION OF PREFERRED EMBODIMENT

Figure 1:
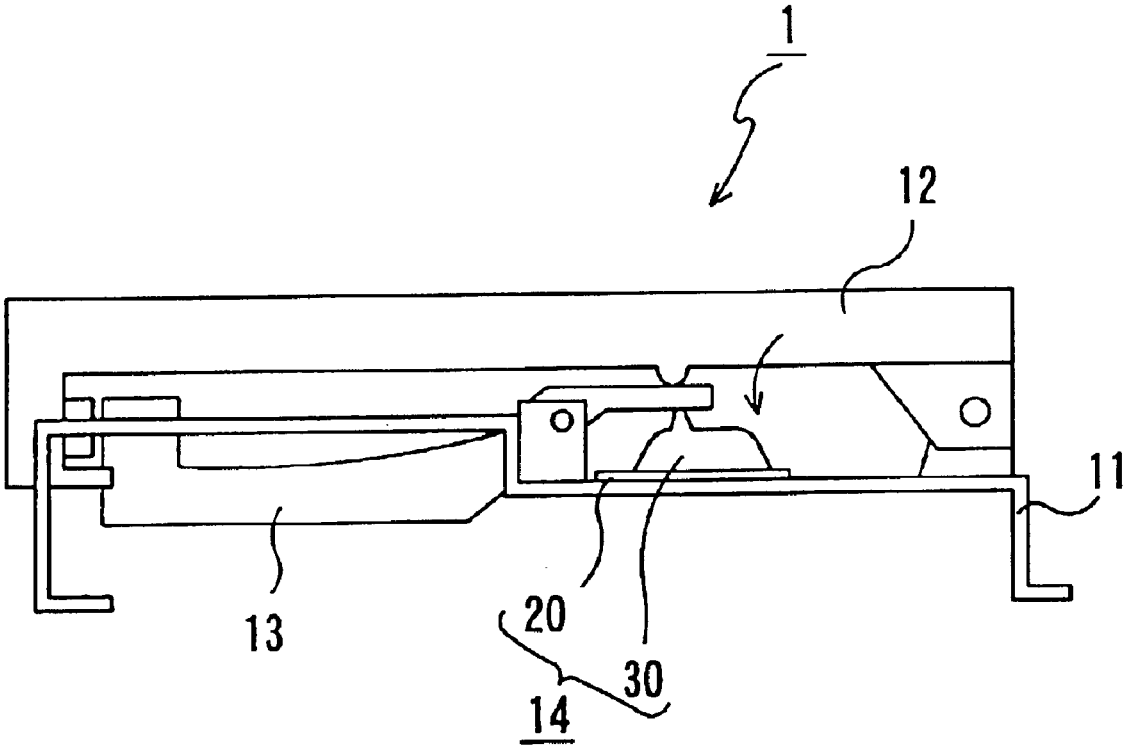
FIG. 1 is a view showing essential parts of a keyboard instrument.

As shown in FIG. 1, a keyboard instrument 1 comprises a keyboard chassis 11, a key 12 and a hammer 13 pivotally mounted on the keyboard chassis 11, a detection device 14 mounted on the upper surface of the keyboard chassis 11 for detecting a depressing action of the key 12 and others. In the keyboard instrument 1, a plurality of keys 12 are arranged and a hammer 13 and a detection device 14 are provided for each key 12, i.e., both the number of the hammers 13 and the number of the detection devices 14 are the same as the number of the keys 12.

Figure 2:
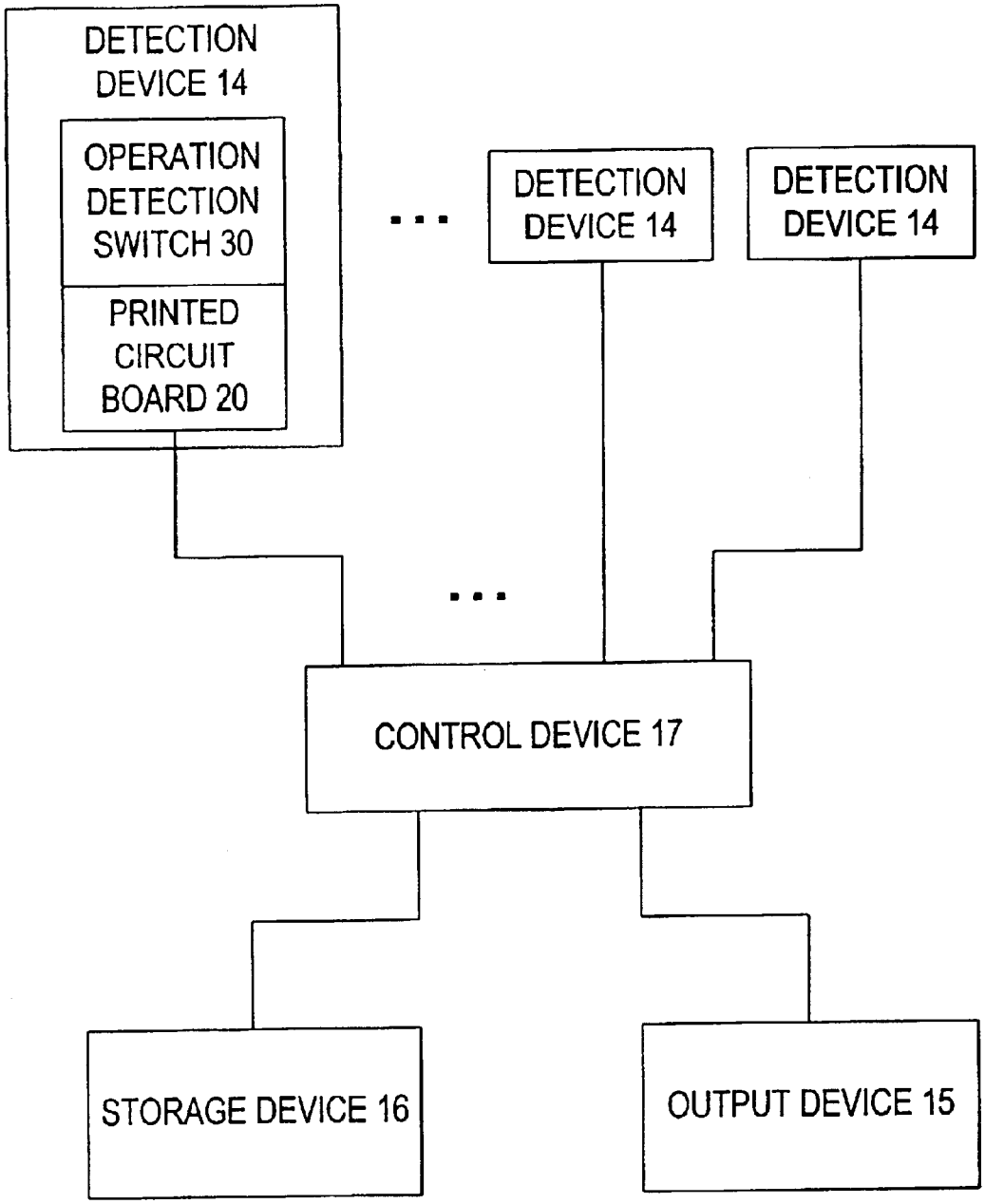
FIG. 2 is a block diagram, showing essential parts of the keyboard instrument.

The keyboard instrument 1 is also provided with, as shown in FIG. 2, an output device 15 including a sound source circuit, a D/A converter, an amplifier, a loudspeaker, etc., a storage device 16, and a control device 17 for controlling the performance of the entire keyboard instrument 1. A data table to be used for determining the sound parameters (tone and volume) in the after-mentioned parameter determination processing is stored in the storage device 16. The control device 17 is designed such that it determines sound parameters in the after-mentioned parameter determination processing when a depressing action of the key 12 is detected with the detection device 14, and outputs a sound with a pitch corresponding to the key 12 whose depressing action has been detected in accordance with the determined parameters through the output device 15.

The detection device 14 comprises a printed circuit board 20 and an operation detection switch 30 mounted on the upper surface of the printed circuit board 20, as shown in FIG. 1. The printed circuit board 20 has a first fixed contact f1 and a second fixed contact f2 formed in sequence along the length direction of the key 12, as shown in FIG. 1 and FIG. 3.

Figure 3:
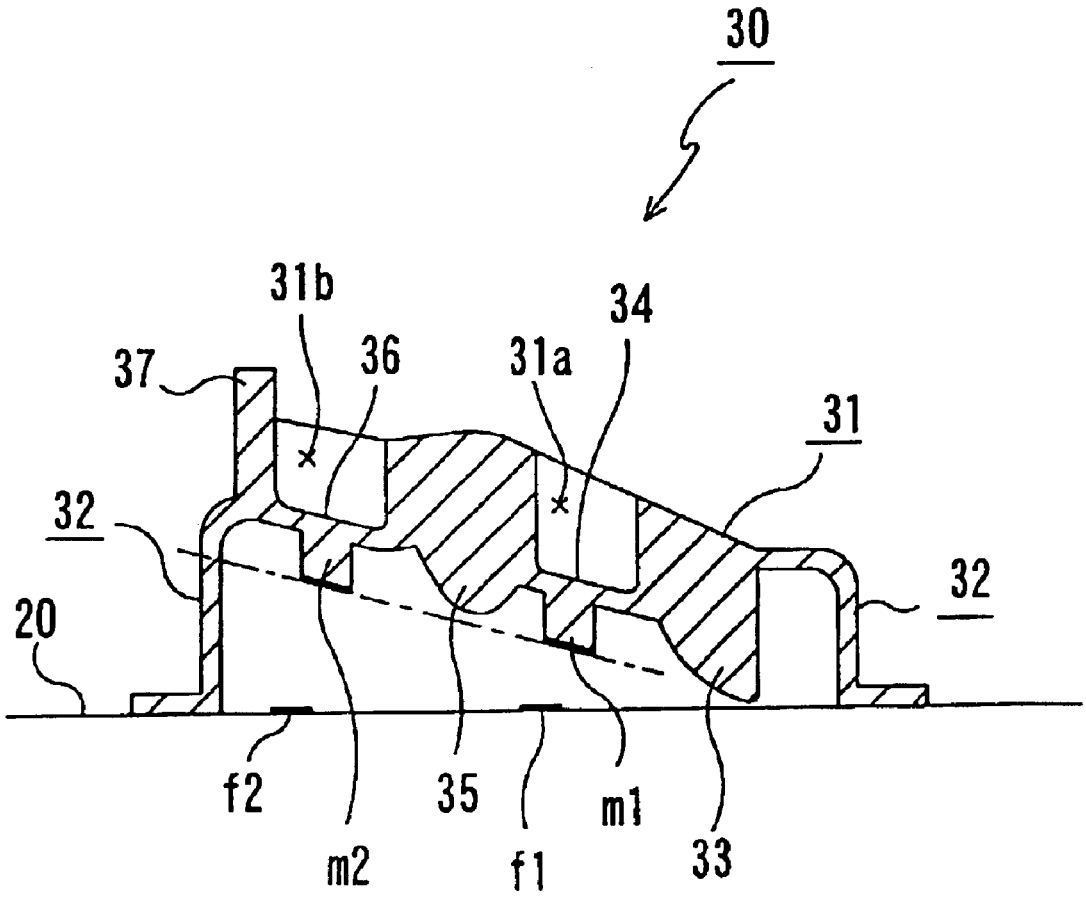
FIG. 3 is a cross sectional view of an operation detection switch mounted on a printed circuit board.

The operation detection switch 30, which is integrally formed out of insulating silicone rubber, comprises a switch main body 31 disposed so as to face the upper surface of the printed circuit board 20 and leg portions 32 for supporting one end (the right end in FIG. 3) of the switch main body 31 and the other end (the left end in FIG. 3) thereof, as shown in FIG. 3.

The switch main body 31 is provided with, in sequence from the one end to the other end, a fulcrum projection 33, a first extending portion 34, a protrusion 35, a second extending portion 36, all of which extend toward the upper surface of the printed circuit board 20. The first and second extending portions 34 and 36 extend from the respective lower ends of recesses 31*a* and 31*b* formed in the switch main body 31, and the joining portion of the first or the second extending portion 34 or 36 with the switch main body 31 is thin. Since the operation detection switch 30 is made of silicone rubber, the first and the second extending portions 34 and 36 are designed so as to be buried in the recesses 31*a* and 31*b*, respectively, as a result of elastic deformation of the thin joining portions with the switch main body 31. Movable contacts m1 and m2 corresponding to the first and the second fixed contacts f1 and f2 on the printed circuit board 20 are attached to the respective tips of the first and the second extending portions 34 and 36. The movable contacts m1 and m2 constitute switches s1 and s2 in cooperation with the fixed contacts f1 and f2. The other end of the switch main body 31 is provided with an upward pressure projection 37, which is depressed by the key 12 via one end of the hammer 13 (the right side in FIG. 1) in accordance with the depression of the key 12 (See the arrow in FIG. 1).

The switch main body 31 is designed such that the respective tip positions (the positions of the lower tips in FIG. 3) of the fulcrum projection 33, the first extending portion 34, the protrusion 35 and the second extending portion 36 are close to the printed circuit board 20 in the order of the fulcrum projection 33, the first extending portion 34, the protrusion 35 and the second extending portion 36 in the initial state when the key 12 is not depressed. The tip position of the protrusion 35 is more distant from the upper surface of the printed circuit board 20 than the straight line (see the alternate long and short dash line in FIG. 3) linking the tips of the first and the second extending portions 34 and 36.

The action procedure of the operation detection switch 30 is described below with reference to FIG. 4.

As the key 12 is depressed, the fulcrum projection 33 abuts the upper surface of the printed circuit board 20, and the switch main body 31 pivots around the fulcrum projection 33 as the first fulcrum due to the pressure of the key 12. As a result, the movable contact m1 of the first extending portion 34 abuts the first fixed contact f1 (see FIG. 4A) then the movable contact m2 of the second extending portion 36 abuts the second fixed contact f2 (see FIG. 4B). In this case, once the movable contact m1 abuts the first fixed contact f1, the first extending portion 34 becomes deformed to be gradually buried into the recess 31*a* (see arrow a1 in FIGS. 4B and 4C), with the movable contact m1 remains abutting the first fixed contact f1.

Figure 4A:
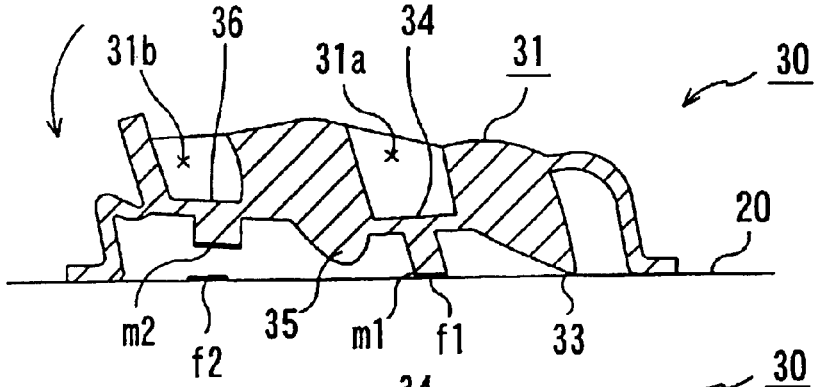
FIGS. 4A through 4E are views showing the action procedure of the operation detection switch.
Figure 4B:
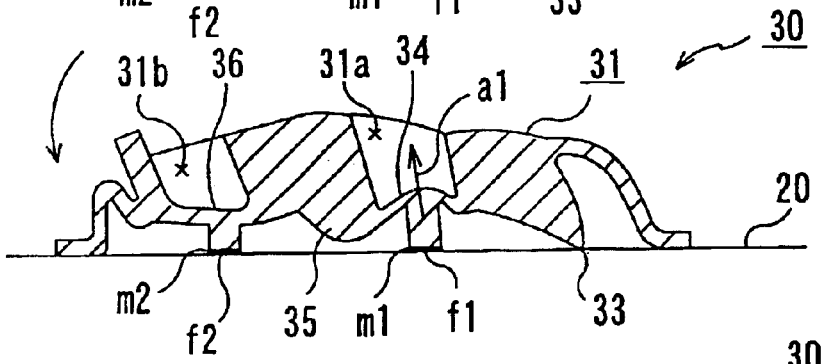
Figure 4C:
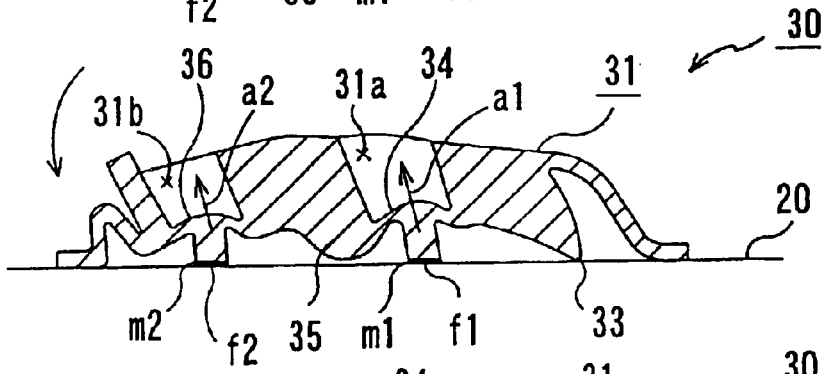
Figure 4D:
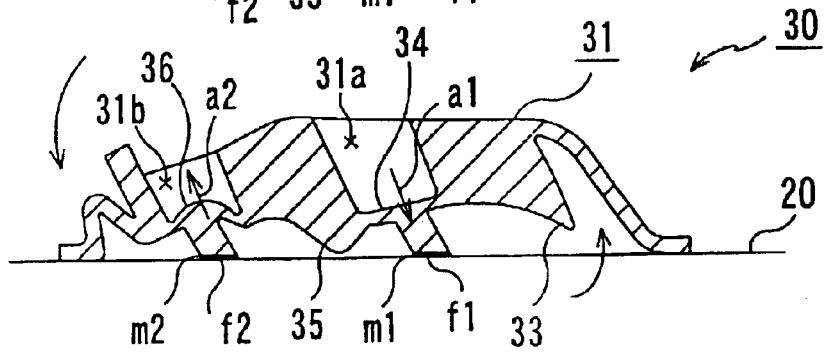

As the key 12 is further depressed, the protrusion 35 abuts the upper surface of the printed circuit board 20 (see FIG. 4C), then the second extending portion 36 becomes deformed with the movable contact m2 of second extending portion 36 remains abutting the second fixed contact f2 while the switch main body 31 pivots around the protrusion 35 as the second fulcrum point (see FIG. 4D). After the switch main body 31 starts pivoting around the protrusion 35 as the second fulcrum point, the fulcrum projection 33 becomes separate from the upper surface of the printed circuit board 20. In this case, once the movable contact m2 abuts the second fixed contact f2, the second extending portion 36 becomes deformed to be gradually buried into the recess 31*b* (see arrow a2 in FIGS. 4C and 4D), while the movable contact m2 remains abutting the second fixed contact f2. In turn, once the switch main body 31 starts pivoting around the protrusion 35 as the second fulcrum point, the first extending portion 34 gradually becomes free from elastic deformation to project from the recess 31*a* (see arrow a1 in FIG. 4D), while the movable contact m1 remains abutting the first fixed contact f1.

Thus, the switch main body 31 continues pivoting until the first extending portion 34 is completely released from elastic deformation, the movable contact m1 becomes separate from the first fixed contact f1 (see FIG. 4E) and finally the other end of the switch main body 31 abuts the upper surface of the printed circuit board 20.

Figure 5:
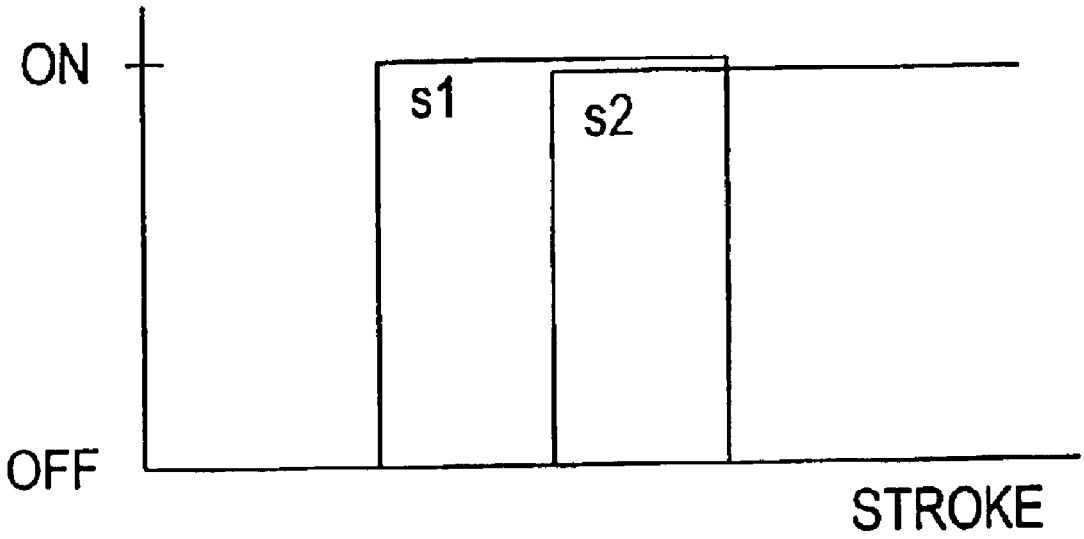
FIG. 5 is a view showing the relation between a stroke and the acting time of the operation detection switch.

In accordance with the above described action procedure, the detection device 14 comprising the printed circuit board 20 and the operation detection switch 30 detects a depressing action of the key 12 by outputting, to the control device 17, an ON signal caused by a switch s1 (the movable contact m1 of the first extending portion 34 and the first fixed contact f1) being ON (closed) and an OFF signal caused by the switch s1 being OFF (opened), as well as an ON signal caused by a switch s2 (the movable contact m2 of the second extending portion 36 and the second fixed contact f2) being ON (closed) and an OFF signal caused by the switch s2 being OFF (opened). FIG. 5 is a graph in which the stroke of depressing the key 12 is plotted in abscissa and the state of action (ON or OFF) of the switches s1 and s2 in ordinate.

The control device 17 into which these ON signals and OFF signals are input determines the parameters of a sound corresponding to the depressing action of the key 12 in accordance with the after-mentioned parameter determination processing.

The parameter determination processing performed by the control device 17 will be described below with reference to FIG. 6. The parameter determination processing is started when an ON signal from the switch s1 is input. When an ON signal is output from the switch s1, the switch s1 is in the ON state as shown in FIG. 4A.

When the processing is started, the control device 17 firstly starts a first timer (s11).

Then, the control device 17 checks whether or not the switch s1 is OFF (s12). In this processing, it is determined that the switch s1 is OFF if an OFF signal is input from the switch s1, and that the switch s1 is not OFF if an OFF signal is not input from the switch s1. Thus, it is checked whether the switch s1 is OFF before the key 12 is completely depressed, that is, whether the depressing action of the key 12 is stopped in the middle of action.

If it is determined at s12 that the switch s1 is not OFF (s12: NO), the control device 17 checks whether or not the switch s2 is ON (s13). In this processing, it is determined that the switch s2 is ON if an ON signal is input from the switch s2, and that the switch s2 is not ON if an ON signal is not input from the switch s2. When an ON signal is output from the switch s2, the switch s2 is in the state of ON as shown in FIG. 4B.

If it is determined at s13 that the switch s2 is not ON (s13: NO), processing returns to s12.

If it is determined at s13 that the switch s2 is ON (s13: YES), the control device 17 stops the first timer and starts the second timer at the same time (s14). By stopping the first timer, a time T1 from when the switch s1 becomes ON until when the switch s2 becomes ON is measured.

Subsequently, the control device 17 checks whether or not the switch s2 is OFF (s15). In this processing, it is determined that the switch s2 is OFF if an OFF signal is input from the switch s2, and that the switch s2 is not OFF if an OFF signal is not input from the switch s2.

If it is determined at s15 that the switch s2 is OFF (s15: YES), the control device 17 resets the second timer (s16). By this, a time T2 which has been measured by the second timer becomes "0".

Figure 4E:
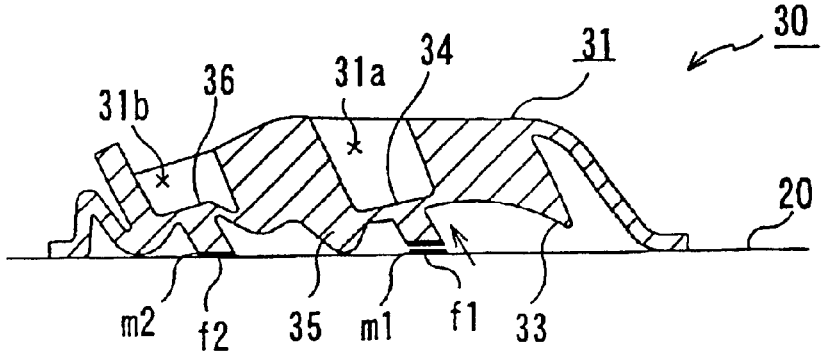

If it is determined at s15 that the switch s2 is not OFF (s15: NO), the control device 17 checks whether or not the switch s1 is OFF (s17). In this processing, it is determined that the switch s1 is OFF if an OFF signal is input from the switch s1, and that the switch s1 is not OFF if an OFF signal is not input from the switch s1. When an OFF signal is output from the switch s1, the switch s1 is in the OFF state as shown in FIG. 4E.

If it is determined at s17 that the switch s1 is not OFF (s17: NO), processing returns to s15.

If it is determined at s17 that the switch s1 is OFF (s17: YES), the control device 17 stops the second timer. By stopping the second timer, the time T2 from when the switch s2 becomes ON until when the switch s1 becomes OFF is measured.

After finishing the processing at s16 or the processing at s18, the control device 17 determines sound parameters based on the time T1 measured by the first timer and the time T2 measured by the second timer (s19). In this processing, the sound parameters are determined based on a data table stored in the storage device 16. As shown in FIG. 7, data indicating various tones and volumes corresponding to combinations of the time T1 measured by the first timer and the time T2 measured by the second timer is contained in the data table. Accordingly, the control device 17 searches for the data corresponding to the combination of the time T1 measured by the first timer and the time T2 measured by the second timer in the data table, and determines the tone and the volume indicated by the retrieved data as the parameters of the sound to be output from the output device 15.

When it is determined in the processing at s12 that the switch s1 is OFF (s12: YES), or the processing at s19 is finished, the control device 17 resets the first and the second timers (s20).

The control device 17 which determines the parameters of the sound to be output in the above described parameter determination processing at s19 functions as parameter determination means in the present invention.

According to the keyboard instrument 1 in the present embodiment, although the number of the fixed contacts f1 and f2 formed for each operation detection switch 30 is two, the depressing action of the key 12 can be detected at three points. As a result, the wiring pattern to be formed on the printed circuit board 20 may be simplified compared with the case of detecting the depressing action of the key 12 by means of three contacts, which enables downsizing of the printed circuit board 20 itself. Therefore, reduction of the manufacturing cost of the entire keyboard 1 will be achieved.

Also, according the operation detection switch 30 in the present embodiment, three time points, i.e., a time point when the movable contact m1 of the first extending portion 34 abuts the first fixed contact f1, a time point when the movable contact m2 of the second extending portion 36 abuts the second fixed contact f2 and a time point when the movable contact m1 of the first extending portion 34 detaches from the first fixed contact f1, can be detected by means of two movable contacts m1 and m2. Therefore, merely two movable contacts m1 and m2 can cover a manner of musical performance in which the speed of depressing the key 12 changes in the middle of action, and thus the manufacturing cost of the above operation detection switch itself may be reduced compared with an operation detection switch for detecting the depressing action of the key 12 by means of three movable contacts.

Since the pressure projection 37 is provided at the other end of the switch main body 31, the switch main body 31 is pressed by the key 12 through the pressure projection 37. This serves to prevent the point to be pressed by the key 12 (the point of pressure application) from shifting from the other end of the switch main body 31, compared with a structure without the pressure projection 37. If the point to be pressed by the key 12 shifts, the load necessary for pivoting the switch main body 31 may change, and as a result, the timing of the movable contacts m1 and m2 of the first and the second extending portions 34 and 36 abutting the first and the second fixed contacts f1 and f2 may be shifted. Therefore, the operation detection switch 30 having a structure according to the present embodiment enables stabilization of its own performance.

The switch main body 31, which pivots around the fulcrum projection 33 as the first fulcrum point, serves to prevent the point (the fulcrum) at which the switch main body 31 abuts the upper surface of the printed circuit board 20 from shifting from the one end of the switch main body 31, compared with a structure without the fulcrum projection 33. If the point (the fulcrum) at which the switch main body 31 abuts the upper surface of the printed circuit board 20 shifts, the load necessary for pivoting the switch main body 31 may change, and as a result, the timing of the movable contacts m1 and m2 of the first and the second extending portions 34 and 36 abutting the first and the second fixed contacts f1 and f2 may be shifted. Therefore, the operation detection switch 30 having a structure according to the present embodiment enables stabilization of its own performance.

Even after the movable contacts m1 and m2 abut the first and the second contacts f1 and f2, the extending portions 34 and 36 become further elastically deformed in accordance with the depressing action of the key 12 while maintaining the abutment of the contacts. The further elastic deformation can ease the shock applied by the protrusion 35 when abutting the upper surface of the printed circuit board 20. Accordingly, damage of the printed circuit board 20 and the operation detection switch 30 itself can be prevented even if the key 12 is depressed with a strong force.

[Modification]

It is to be understood that the present invention should not be limited to the above described embodiment, but may be embodied in various forms.

For example, while the operation detection switch 30 is used for detecting the depression of each of the keys 12 as the operating portion of the keyboard instrument 1 in the present embodiment, the operation detection switch 30 may be used for detecting the depression of a pad as the operating portion of a percussion instrument such as electronic drums.

The operation detection switch 30, which is formed out of silicone rubber in the present embodiment, may be formed out of other elastic materials such as a resin material.

While the first and the second fixed contacts f1 and f2 of the printed circuit board 20 are formed in sequence along the length direction of the key 12 in the present embodiment, the first and the second fixed contacts f1 and f2 may be formed in sequence along the direction perpendicular to the length direction of the key 12. In this case, the operation detection switch 30 is also arranged along the direction perpendicular to the length direction of the key 12. Alternatively, the first and the second fixed contacts f1 and f2 may be formed in sequence along the direction having a certain angle to the length direction of the key 12.

Figure 8:
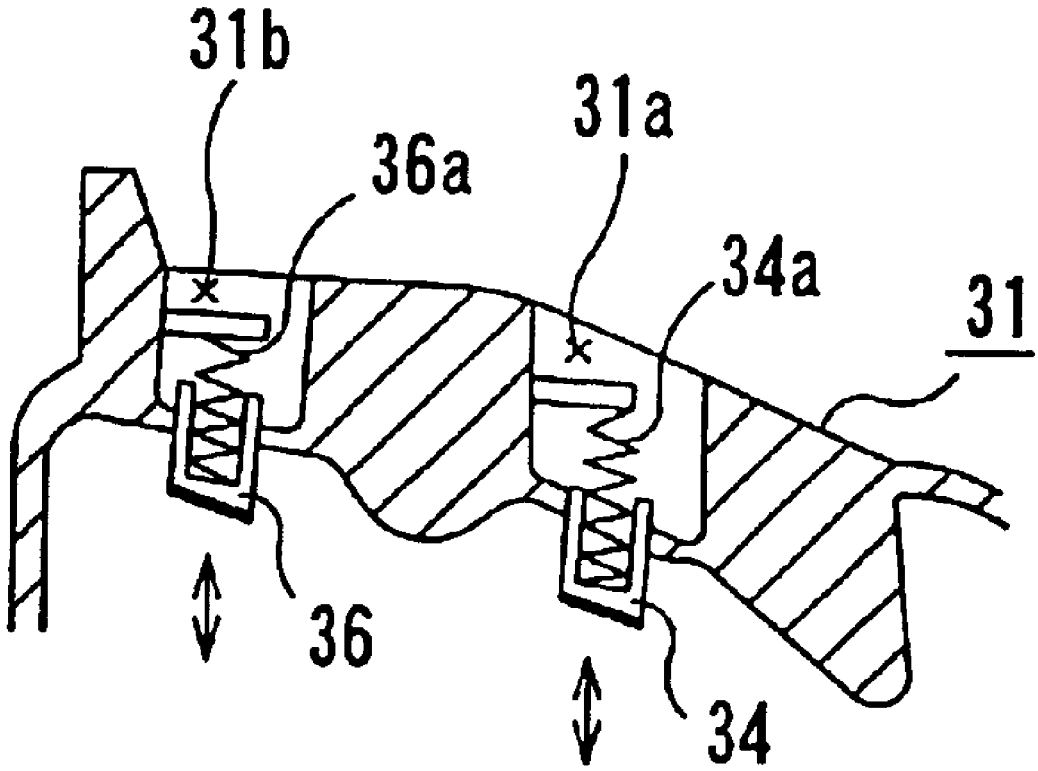
FIG. 8 is a cross sectional view showing the switch main body in another embodiment.

In the operation detection switch 30 of the present embodiment, the first and the second extending portions 34 and 36 are designed to be buried into the recesses 31*a* and 31*b* by elastically deforming the joining portions with the switch main body 31. However, the first and the second extending portions 34 and 36 may be designed, as shown in FIG. 8, such that elastic members 34*a* and 36*a* such as springs, which are disposed within the first and the second extending portions 34 and 36, enable the first and the second extending portions 34 and 36 to be buried into the recesses 31*a* and 31*b* in accordance with the deformation of the elastic member 34*a* and 36*a*.

In the operation detection switch 30 of the present embodiment, as the key 12 is depressed, the fulcrum projection 33 abuts the upper surface of the printed circuit board 20, then the switch main body 31 pivots around the fulcrum projection 33 as the first fulcrum point. However, the fulcrum projection 33 may be designed so as to abut the upper surface of the printed circuit board 20 from the beginning, i.e., in the initial state before the key 12 is depressed. In this case, since the fulcrum projection 33 abuts the upper surface of the printed circuit board 20 from the beginning, the abutting point of the fulcrum projection 33 and the upper surface of the printed circuit board 20 is prevented from being shifted every time the depressing action is performed, and thus the performance of the operation detection switch 30 itself may be stabilized.

In the operation detection switch 30 of the present embodiment, the tip of the protrusion 35 is more distant from the upper surface of the printed circuit board 20 than the line linking the tips of the first and the second extending portions 34 and 36. The tip of the protrusion 35, however, may be closer to the upper surface of the printed circuit board 20 than the line linking the tips of the first and the second extending portions 34 and 36 as long as the fulcrum projection 33 and the first extending portion 34 abut the upper surface of the printed circuit board 20 in this order in the process of depression of the key 12. In this case, the movable contact m2 of the second extending portion 36 abuts the second fixed contact f2 after the protrusion 35 abuts the upper surface of the printed circuit board 20.

While the operation detection switch 30 is designed such that the switch main body 31 pivots around the fulcrum projection 33 as the first fulcrum point in the present embodiment, the first fulcrum point around which the switch main body 31 is to pivot may have the following structure.

Figure 9A:
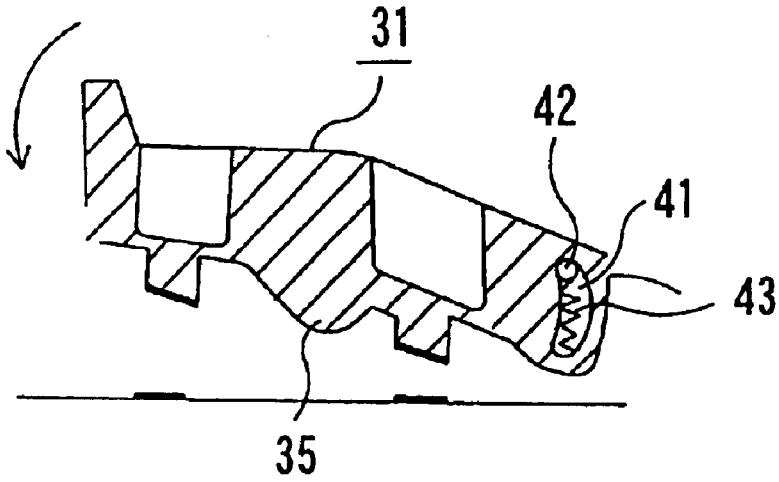
FIGS. 9A and 9B are cross sectional views showing the switch main body in a further embodiment.
Figure 9B:
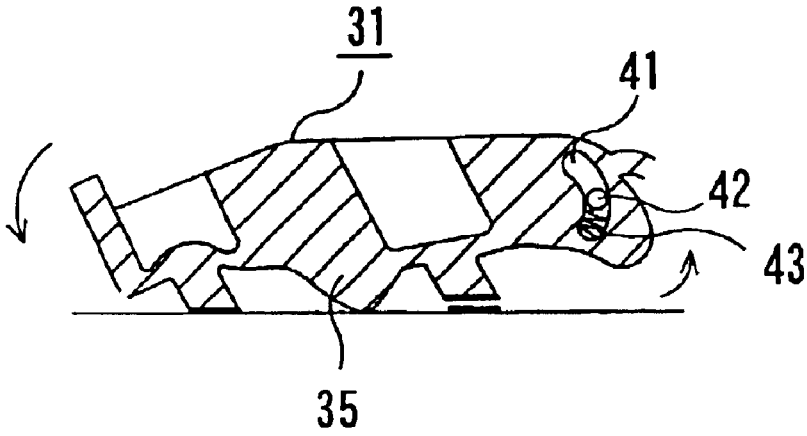

Specifically, an elongate hole 41 elongated in the up/down direction is provided at one end of the switch main body 31, as shown in FIG. 9, and a bar-like member 42 which passes through the elongate hole 41 transversely is fixed to prevent displacement thereof. The switch main body 31 is biased toward the bar-like member 42 by means of an elastic member 43 such as a spring, so that the bar-like member 42 is positioned at the upper end of the elongate hole 41. According to this structure, as the key 12 is depressed, the switch main body 31 pivots around the bar-like member 42 as a first fulcrum point due to the pressure of the key 12 (See FIG. 9A). As the key 12 is further depressed, the switch main body 31 pivots around the protrusion 35 as a second fulcrum point, while the bar-like member 42 is displaced toward the lower end of the elongate hole 41(See FIG. 9B).

Figure 6:
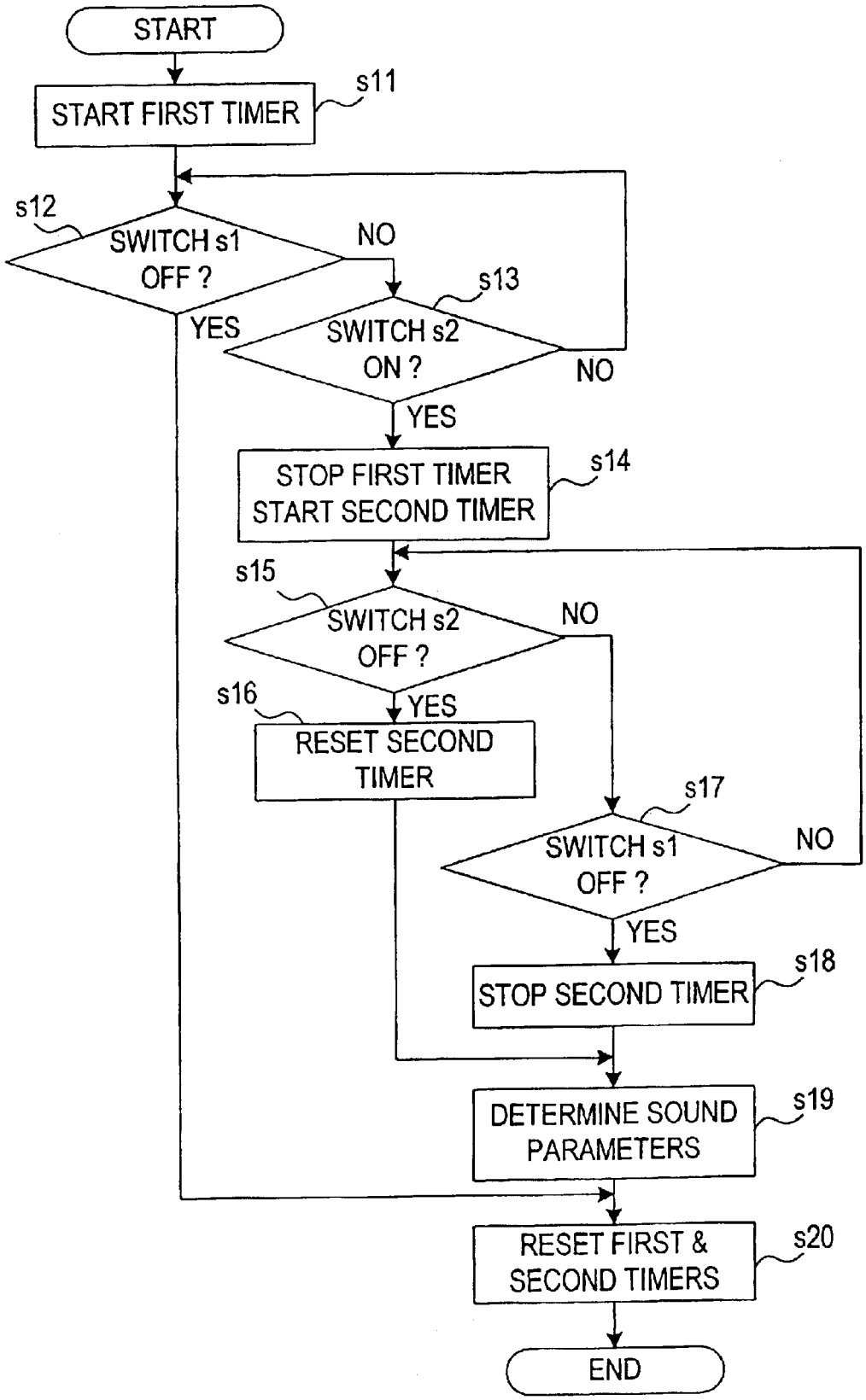
FIG. 6 is a flowchart showing the procedure of parameter determination processing.

The keyboard instrument 1 in the present embodiment is designed to determine sound parameters based on a data table by the processing at s19 in FIG. 6. However, the method for determining sound parameters is not limited to this. For example, sound parameters may be determined based on values with respect to the tone and the volume which are calculated from the time T1 measured by the first timer and the time T2 measured by the second timer. Alternatively, sound parameters may be determined based on values with respect to the tone and the volume calculated from the measured time T1, the measured time T2 and the sound's pitch corresponding to the key 12 in connection with which the depressing action is detected.

In the processing at s19 in FIG. 6 of the present embodiment, among the data registered in the data table, parameters indicated by the data corresponding to the combination of the time T1 measured by the first timer and the time T2 measured by the second timer are determined as the sound parameters. In the processing at s19, if the second timer is reset by the processing at s16, data including the time T2 measured by the second timer of "0" is retrieved. It is assumed that the depressing action of the key 12, which results in the time T2 measured by the second timer of "0," is the action of stopping the depression of the key 12 after the switch s2 becomes ON and before the switch s1 becomes OFF such as the case of continually depressing the key 12 at a high speed. Therefore, data indicating the tone and the volume in the case of continually depressing the key 12 at a high speed should be registered in the data table as the data corresponding to the combination including the time T2 measured by the second timer of "0". By this, when the action of continually depressing the key 12 at a high speed is performed, the sound corresponding to such a depressing action can be output from the output device 15.

The control device 17 may be designed not to output a sound from the output device 15 in the case where the total time of the time T1 measured by the first timer and the time T2 measured by the second timer excesses a predetermined threshold value in the processing at s19. It is assumed that the depressing action of the key 12 providing a longer total time of the time T1 measured by the first timer and the time T2 measured by the second timer is in the state of "let-off" in which the key 12 is depressed slowly. "Let-off" here means the state in which no sound is produced in spite of the depression of the key. By setting the above-mentioned threshold to a time which is assumed to provide the "let-off" state, the present keyboard instrument 1 can cover the let-off state.

In the present embodiment, sound parameters are determined in the processing at s19. It may be possible, however, that when the first timer is stopped in the processing at s14, the parameters corresponding to the time T1 measured by the first timer are determined and the sound having the determined parameters is output from the output device 15, while the parameters corresponding to the time T2 measured by the second timer are determined and the sound having the determined parameters is output from the output device 15 in the processing at s19. By this, even when an action of stopping the depression of the key 12 after the switch s2 becomes ON and before the switch s1 becomes OFF is performed such as the case of continually depressing the key 12 at a high speed, the sound corresponding to such a depressing action can be output from the output device 15.

Further, in the present embodiment, the second timer is reset when it is determined that the switch s2 is OFF by the processing at s15. It may be possible, however, that the second timer is reset in the processing at s16 when the time T2 measured by the second timer excesses a predetermined threshold value.

In the parameter determination processing according to the present embodiment shown in FIG. 6, when an ON signal or an OFF signal from each of the switches s1 and s2 of the detection device 14 is input, it is determined that the switch s1 or s2 is ON or OFF. However, when each switch s1 or s2 becomes ON or OFF, chattering, i.e., repeatedly becoming ON and OFF at short intervals, may occur. Once chattering occurs, the control device 17 may determine that each switch s1 or s2 has been ON only in a short time period, thereby making the output device 15 output a sound having different parameters from those of the sound intended by the player. Therefore, the control device 17 may be designed to perform switch action determination processing showing in FIG. 10 so as to accurately determine whether each switch s1 or s2 is ON or OFF. The switch action determination processing is performed in parallel with the parameter determination processing shown in FIG. 6 when an ON signal is input from the switch s1.

First, the control device 17 starts a first chattering timer (s21). Then, the control device 17 checks whether or not a predetermined time (e.g. 0.2 ms) has elapsed since the first timer was started (s22). The predetermined time, here, means a previously set time period long enough for chattering to be over.

If it is determined in the processing at s22 that the predetermined time has not elapsed since the first chattering timer was started (s22: NO), the control device 17 checks whether or not an ON signal has been input from the switch s2 (s23).

If it is determined in the processing at s23 that an ON signal has not been input from the switch s2 (s23: NO), the process returns to s22.

If it is determined in the processing at s23 that an ON signal has been input from the switch s2 (s23: YES), the control device 17 determines that the switch s1 is ON (s24). By determining that the switch s1 is ON, the parameter determination processing shown in FIG. 6 is started. Once the parameter determination processing is started, the first chattering timer is stopped or reset.

Alternatively, if it is determined at s22 that a predetermined time has elapsed since the first chattering timer was started (s22: YES), the control device 17 determines that the switch s1 is ON (s25). By determining that the switch s1 is ON, the parameter determination processing shown in FIG. 6 is started, and the first chattering timer is stopped or reset in the same manner as in the processing at s24.

Then, the control device 17 waits until an ON signal is input from the switch s2 (s26: NO).

When determining that an ON signal has been input from the switch s2 (s26: YES), or finishing the processing at s24, the control device 17 starts a second chattering timer (s27).

Subsequently, the control device 17 checks whether or not a predetermined time (e.g. 0.2 ms) has elapsed since the second chattering timer was started (s28).

If it is determined in the processing at s28 that the predetermined time has not elapsed since the second chattering timer was started (s28: NO), the control device 17 checks whether or not an OFF signal has been input from the switch s1 (s29).

If it is determined in the processing at s29 that an OFF signal has not been input from the switch s1 (s29: NO), the process returns to s28.

If it is determined in the processing at s29 that an OFF signal has been input from the switch s1 (s29: YES), the control device 17 determines that the switch s2 is ON (s30). Once it is determined that the switch s2 is ON, the process goes from the processing at s13 to the processing at s14 shown in FIG. 6. Also, in the processing at s30, the second chattering timer is stopped or reset.

Alternatively, if it is determined at s28 that a predetermined time has elapsed since the second chattering timer was started (s28: YES), the control device 17 determines that the switch s2 is ON (s31). Once it is determined that the switch s2 is ON, the process goes from the processing at s13 to the processing at s14 shown in FIG. 6, and the second chattering timer is stopped or reset in the same manner as in the processing at s30.

Then, the control device 17 waits until an OFF signal is input from the switch s1 (s32: NO).

When determining that an OFF signal has been input from the switch s1 (s32: YES), or finishing the processing at s30, the control device 17 starts a first chattering timer (s33).

Subsequently, the control device 17 waits until a predetermined time (e.g. 0.2 ms) has elapsed since the first chattering timer was started (s34: NO).

If it is determined in the processing at s34 that the predetermined time has elapsed since the first chattering timer was started (s34: YES), the control device 17 determines that the switch s1 is OFF (s35). Once it is determined that the switch s1 is OFF, the process goes from the processing at s17 to the processing at s18 shown in FIG. 6. Also, at s35, the first chattering timer is stopped or reset.

Figure 10:
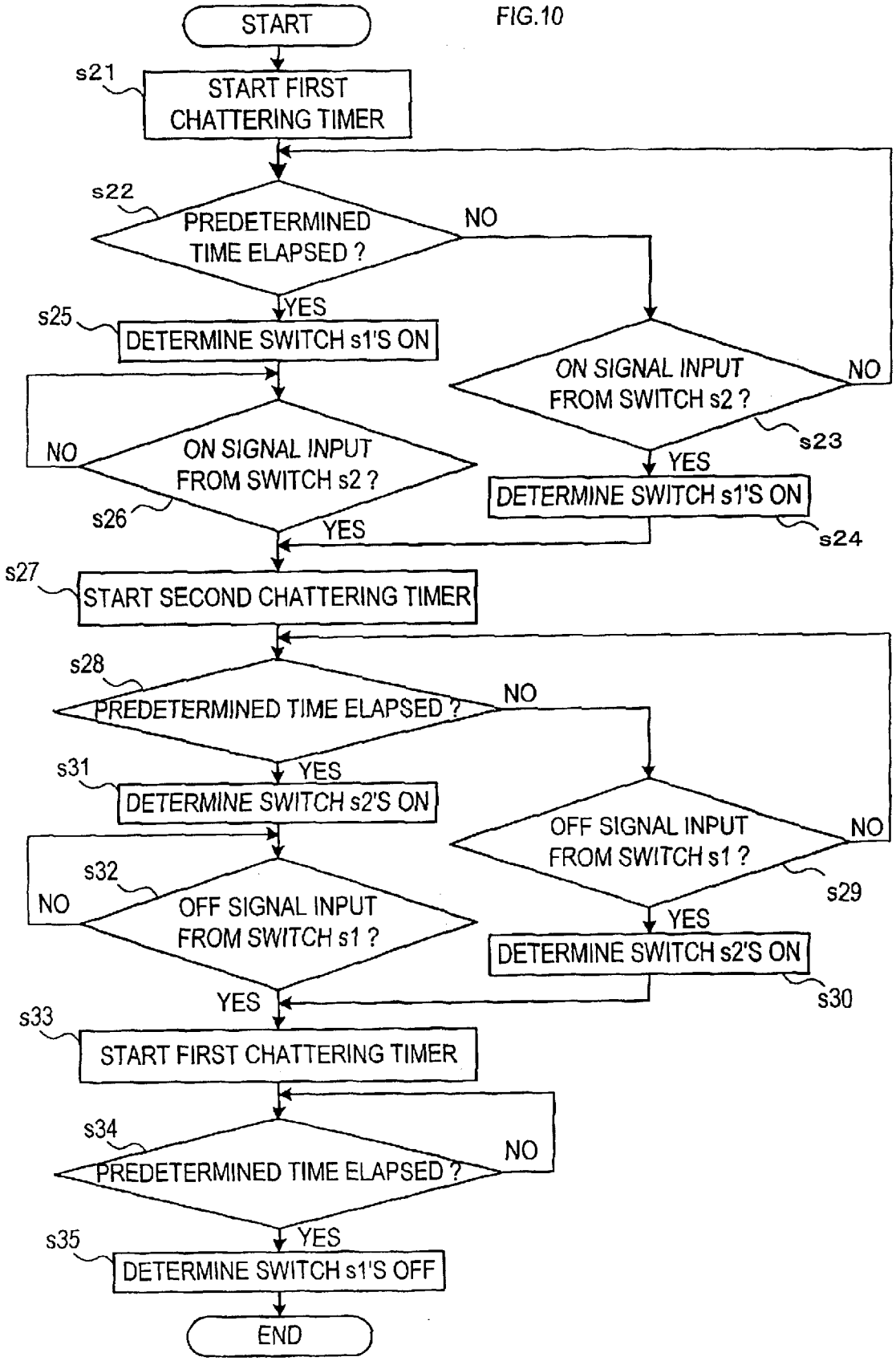
FIG. 10 is a flowchart showing the procedure of switch action determination processing in yet another embodiment.
Figure 11:
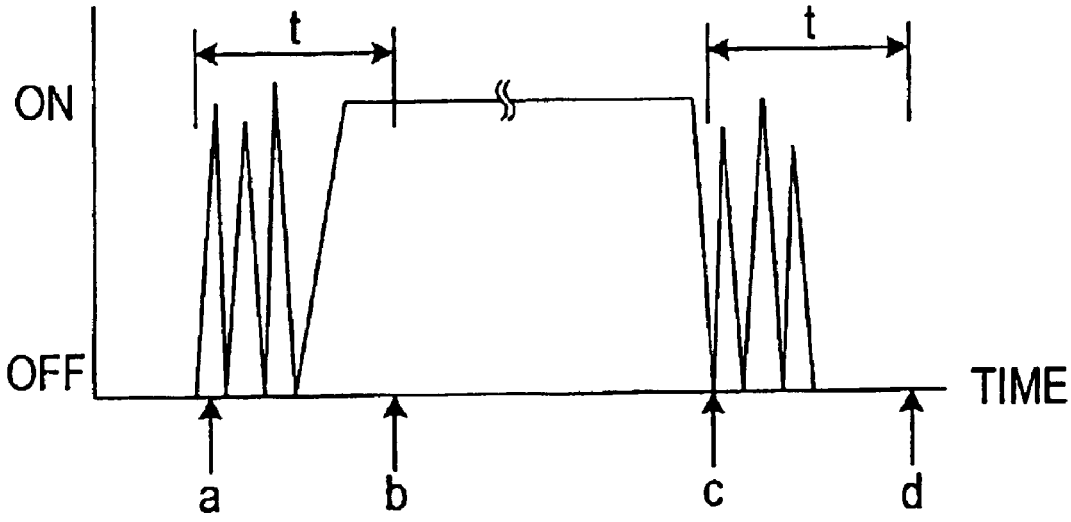
FIG. 11 is a graph showing the relation between the state of action and the elapsed time in the case where chattering occurs while the operation detection switch is in action.
Figure 12A:
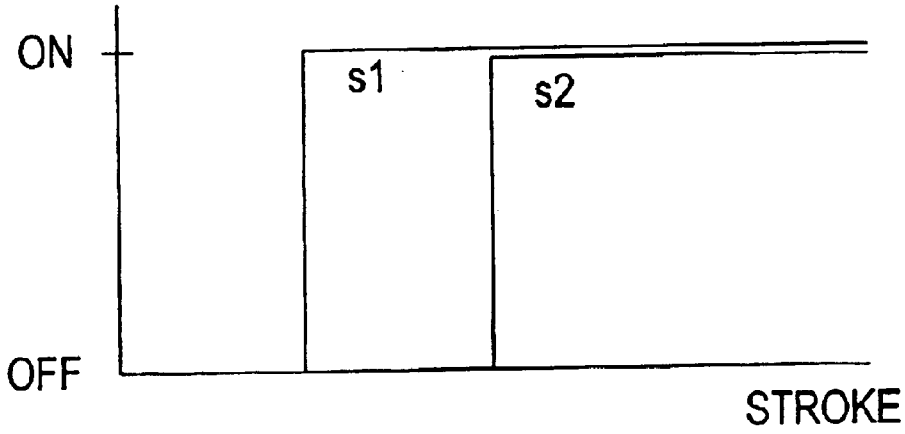
FIGS. 12A and 12B are graphs showing the relation between a stroke and the state of action of a conventional operation detection switch.
Figure 12B:
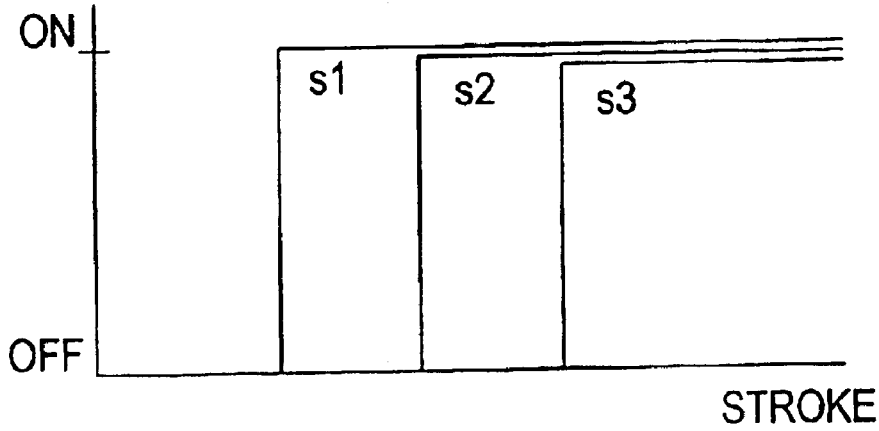
Figure 13A:
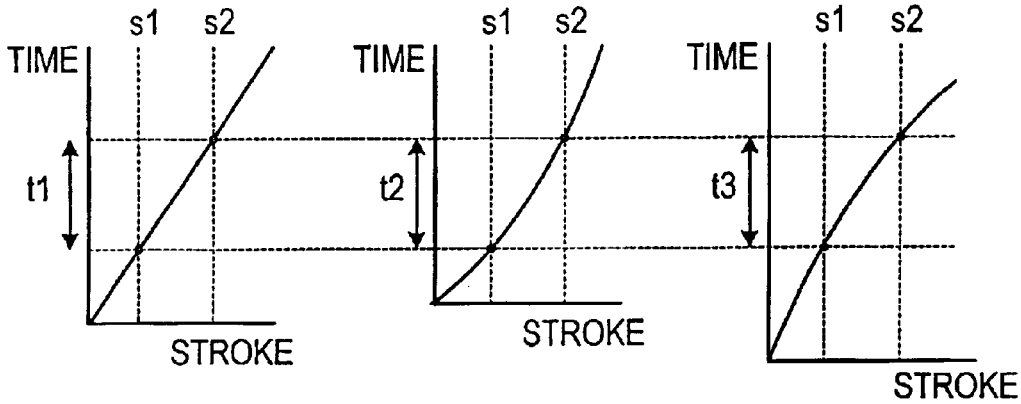
FIGS. 13A and 13B are graphs showing the relation between a stroke and the acting time of conventional operation detection switches.
Figure 13B:
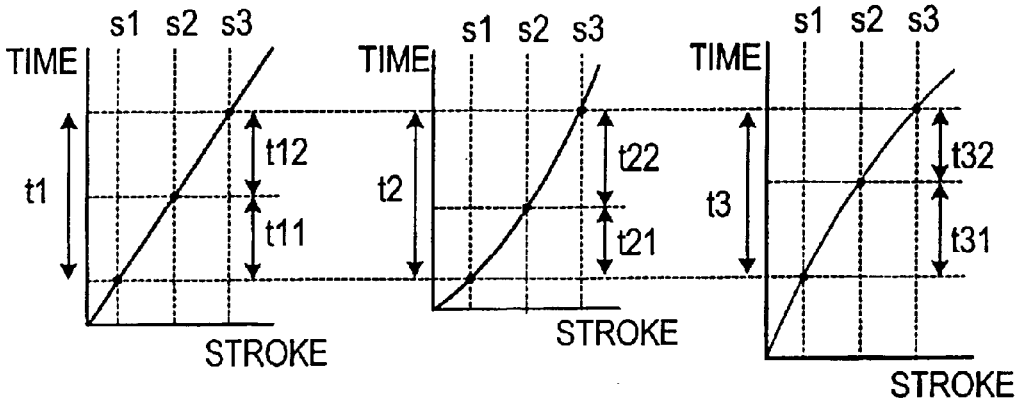

When the switch action determination processing as shown in FIG. 10 is performed in parallel with the parameter determination processing shown in FIG. 6 as described above, even if chattering occurs when an ON signal of the switch is input (see "a" in FIG. 11), it is determined that the switch is ON after a predetermined time t (see "b" in FIG. 11). Therefore, even if an OFF signal is input from the switch while chattering is occurring, it is not to be determined that the switch is OFF. Also, in the case of an OFF signal being input, even if an ON signal is input from the switch while chattering is occurring, it is not to be determined that the switch is ON (see "c", "d" in FIG. 11). Accordingly, it is possible to accurately determine that each switch s1 or s2 is ON or OFF without being influenced by chattering, which can prevent errors such as outputting a sound having different parameters from those of the sound intended by the player.

In the present switch action determination processing, even if it is determined at s22 (or at s28) that the predetermined time has not elapsed, it can be determined that the switch s1 (or the switch s2) is ON when an ON signal from the switch s2 (or an OFF signal from the switch s1) is input. This is to prevent errors such as outputting a sound having different parameters from those of the sound intended by the player in the event that the time period from the ON of the switch s1 (or s2) to the ON of the switch s2 (or the OFF of the switch s1) is shorter than the time measured by the first (or the second) chattering timer, and the switch s2 becomes ON (or the switch s1 is becomes OFF) before it is determined that the switch s1 (or the switch s2) becomes ON.

What is claimed is:

1. An operation detection switch comprising:

a switch main body disposed between an operating portion of a musical instrument and the surface of a circuit board having a first and a second fixed contacts formed thereon;

a first and a second extending portions extending, respectively, from the switch main body and provided at the tips with movable contacts corresponding to the first and the second fixed contacts, when the operating portion is depressed, the switch main body is directly or indirectly pressed by the operating portion and pivots around one end of the switch main body as the first fulcrum point, whereby the movable contact of the first extending portion abuts the first fixed contact, then the movable contact of the second extending portion abuts the second fixed contact, the switch main body being provided with a protrusion protruding toward the surface of the circuit board from between the first and the second extending portions, and wherein as the operating portion is further depressed after the movable contacts of the first and the second extending portions abut the first and the second fixed contacts in sequence, the switch main body pivots around the protrusion as a second fulcrum point with the movable contact of the second extending portion abutting the second fixed contact and the second extending portion being elastically deformed, thereby the movable contact of the first extending portion detaching from the first fixed contact.

2. The operation detection switch as set forth in claim 1, wherein the switch main body is provided with a pressure projection at the opposite end to the first fulcrum point, and wherein the switch main body is pressed by the operating portion through the pressure projection as the operating portion is depressed.

3. The operation detection switch as set forth in claim 1, wherein the switch main body is provided with a fulcrum projection protruding toward the surface of the circuit board at one end of the switch main body, and wherein the switch main body pivots around the fulcrum projection as the first fulcrum point as the operating portion is depressed.

4. A musical instrument comprising: parameter determination mechanism for detecting a depressing action of an operating portion by way of an operation detection switch as set forth in claim 1, and for determining sound parameters in accordance with the detected depressing action, wherein the parameter determination mechanism determine the sound parameters based on a required time period from when the movable contact of the first extending portion abuts the first fixed contact until when the movable contact of the second extending portion abuts the second fixed contact and a required time period from when the movable contact of the second extending portion abuts the second fixed contact until when the movable contact of the first extending portion detaches from the first fixed contact.

5. A parameter determination program for determining sound parameters in accordance with a detected depressing action within a musical instrument capable of detecting a depressing action of an operating portion by way of an operation detection switch as set forth in claim 1, wherein the parameter determination program is used for having a computer system execute the procedure of determining sound parameters based on a required time period from when the movable contact of the first extending portion abuts the first fixed contact until when the movable contact of the second extending portion abuts the second fixed contact and a required time period from when the movable contact of the second extending portion abuts the second fixed contact until when the movable contact of the first extending portion detaches from the first fixed contact.

6. A mechanism for electronically providing a desired characterization to a musical note in a manner corresponding to a musical playing technique, the mechanism comprising:

a moveable main body having a first fulcrum point, a second fulcrum point, a first contact point and a second contact point;

a circuit board having a first fixed contact point and a second fixed contact point corresponding to and spaced from the respective first and second contact points; and wherein upon actuation of the mechanism, rotation of the main body about the first and second fulcrum points induces an interaction of the first and second contact points of the main body with the respective first and second fixed contact points of the circuit board to provide a first time period and a second time period corresponding to the desired characterization of the musical note.

7. The mechanism for electronically providing a desired characterization to a musical note according to claim 6, wherein the first time period is defined between a first reference position where the first contact point connects with the first fixed contact point, and a second reference position where the second contact point connects with the second fixed contact point, and the second time period is defined between the second reference position and a third reference position where the first contact point disconnects from the first fixed contact point.

8. The mechanism for electronically providing a desired characterization to a musical note according to claim 7, wherein the first contact point remains connected with the first fixed contact point throughout the first time period and the second contact point remains connected with the second fixed contact point throughout the second time period.

9. The mechanism for electronically providing a desired characterization to a musical note according to claim 6, wherein the first fulcrum point is positioned at a first end of the main body and the second fulcrum point is positioned at a middle portion of the main body between the first and second contact points.

10. The mechanism for electronically providing a desired characterization to a musical note according to claim 9, wherein the first and second contact points are springably moveable relative to the main body.

11. The mechanism for electronically providing a desired characterization to a musical note according to claim 10, wherein rotation of the main body about a contact between the first fulcrum point and the circuit board connects at least the first contact point with the first fixed contact point, and rotation of the main body about a contact between the second fulcrum point and the circuit board disconnects the first contact point from contact with the first fixed contact point.

12. A musical instrument having a mechanism providing a desired characterization to a musical note in a manner corresponding to a musical playing technique, the musical instrument comprising:

an input corresponding to the musical note;

an operation detection switch connected to the input, the operation detection switch comprising:

a first fulcrum point;

a second fulcrum point;

a first electrical contact;

a second electrical contact; and a circuit board supporting the operation detection switch; and an audible output produced by the musical instrument corresponding to the desired characterization communicated to the operation detection switch from the input.

13. The musical instrument having a mechanism providing a desired characterization to a musical note as set forth in claim 12, wherein the desired characterization is determined according to a comparison of a first measured time period between activation of the first electrical contact and activation of the second electrical contact and a second measured time period between activation of the second electrical contact and inactivation of the first electrical contact.

14. The musical instrument having a mechanism providing a desired characterization to a musical note as set forth in claim 13, wherein the first fulcrum point is positioned at a first end of the switch and the second fulcrum point is positioned at a middle portion of the switch body between the first and second electrical contacts.

15. The musical instrument having a mechanism providing a desired characterization to a musical note as set forth in claim 14, wherein the first and second electrical contacts are springably moveable relative to the switch.

16. The musical instrument having a mechanism providing a desired characterization to a musical note as set forth in claim 15, wherein the first and second time periods are determined according to movement of the switch from a first reference position defined by rotation of the switch about the first fulcrum point and activation of the first electrical contact, to a second reference position defined by further rotation of the switch about the first fulcrum and activation of the second electrical contact, and a third reference position defined by further rotation of the switch about the first and second fulcrum points and inactivation of the first electrical contact.

17. A method for electronically providing a desired characterization to a musical note in a manner corresponding to a musical playing technique, the method comprising the steps of:

providing a mechanism having a main body;

providing the main body with a first fulcrum point, a second fulcrum point, a first contact point and a second contact point;

supporting the main body on a circuit board having a first fixed contact point and a second fixed contact point corresponding to and spaced from the respective first and second contact points; and actuating the mechanism to rotate the main body about the first and second fulcrum points to cause an interaction of the first and second contact points of the main body with the respective first and second fixed contact points of the circuit board to provide a first time period and a second time period based on the interaction of the first and second contact points corresponding to the desired characterization of the musical note.

18. The method for electronically providing a desired characterization to a musical note according to claim 17, further comprising the steps of defining the first time period is between a first reference position where the first contact point connects with the first fixed contact point, and a second reference position where the second contact point connects with the second fixed contact point, and defining the second time period between the second reference position and a third reference position where the first contact point disconnects from the first fixed contact point.

19. The mechanism for electronically providing a desired characterization to a musical note according to claim 18, further comprising the steps of maintaining the first contact point connected with the first fixed contact point throughout the first time period and maintaining the second contact point connected with the second fixed contact point throughout the second time period.

20. The method for electronically providing a desired characterization to a musical note according to claim 17, further comprising the steps of positioning the first fulcrum point at a first end of the main body and positioning the second fulcrum point at a middle portion of the main body between the first and second contact points.

* * * * *